United States Patent [19]

Deve

[11] Patent Number: 4,487,372

[45] Date of Patent: Dec. 11, 1984

[54] THERMAL SAND RECLAMATION SYSTEM

[75] Inventor: Vagn Deve, East Washington, Pa.

[73] Assignee: Combustion Engineering, Inc., Windsor, Conn.

[21] Appl. No.: 369,069

[22] Filed: Apr. 16, 1982

[51] Int. Cl.[3] ..... B02C 19/12

[52] U.S. Cl. ..... 241/65; 110/236; 164/5; 241/69; 241/152 A; 241/284; 241/DIG. 10

[58] Field of Search ..... 241/5, 39, 40, 23, 65, 241/14, DIG. 10, 79, 24, 152 A, 69, 284, 66, 152 R, 67; 164/5, 412; 34/57 A; 110/236

[56] References Cited

U.S. PATENT DOCUMENTS

| | | | |
|---|---|---|---|
| 2,041,721 | 5/1936 | Norton | 241/DIG. 10 X |
| 3,685,165 | 8/1972 | Deve | 34/57 A |
| 3,863,847 | 2/1975 | Day et al. | 241/DIG. 10 X |
| 3,897,910 | 8/1975 | Deve | 241/DIG. 10 X |
| 3,907,213 | 9/1975 | Kauffman | 241/DIG. 10 X |
| 4,283,015 | 8/1981 | Smith | 241/5 |

FOREIGN PATENT DOCUMENTS

| | | | |
|---|---|---|---|
| 2224823 | 11/1973 | Fed. Rep. of Germany | 241/DIG. 10 |

*Primary Examiner*—Mark Rosenbaum
*Attorney, Agent, or Firm*—Arthur E. Fournier, Jr.

[57] ABSTRACT

A system (10) particularly suited for reclaming used foundry sand by means of thermal reclamation. The subject system (10) includes, arranged in cooperatively associated series relation, thermal reclaimer means (14), post reclaimer means (15), primary cooling means (16), separator means (18), classifying and dust removal means (19), scrubber means (20) and secondary cooling means (22). The used sand, which preferably is first fed through a lump-crusher, shake-out apparatus (12), is made to pass through thermal reclaimer means (14) while being heated to a predetermined temperature for a preestablished period of time in order to accomplish the burning away of the organic materials, i.e., matter, which are present in the used sand. From the thermal reclaimer means (14), the used sand passes to and through the post reclaimer means 15 for further reclaiming and then to and through the primary cooling means (16) wherein the heated sand is cooled to a suitable temperature. The separator means (18) is operative to effect the removal of tramp metal from the cooled, thermally reclaimed sand. Thereafter, the cooled, thermally reclaimed sand is made to pass through the classifying and dust removal means (19) for classifying and removal of dust and fines and then through the scrubber means (20) wherein the dust associated with the particles of sand is removed therefrom. Finally, the substantially dust-free, cooled, thermally reclaimed sand passes through the secondary cooling means (22) wherein the sand is further cooled to substantially ambient temperature.

4 Claims, 5 Drawing Figures

THERMAL SAND RECLAMATION SYSTEM

CROSS-REFERENCE TO RELATED APPLICATIONS

This application is hereby cross-referenced to the following four patent applications which were commonly filed herewith and which are commonly assigned: U.S. application Ser. No. 369,068, filed Apr. 16, 1982, entitled "A Lump-Crusher And Shake-Out Apparatus For A Thermal Sand Reclamation System", filed in the name of Vagn Deve; U.S. application Ser. No. 369,334, filed Apr. 16, 1982, entitled "A Thermal Reclaimer Apparatus For A Thermal Sand Reclamation System", filed in the name of Vagn Deve, and which issued on Feb. 7, 1984 as U.S. Pat. No. 4,429,642; U.S. application Ser. No, 369,476, filed Apr. 16, 1982, entitled "A Post Reclaimer, Cooling And Separator Assembly For A Thermal Sand Reclamation System", filed in the name of Vagn Deve; and U.S. application Ser. No. 369,335, filed Apr. 16, 1982, entitled "A Classifying, Scrubber And Cooling Assembly For A Thermal Sand Reclamation System", filed in the name of Vagn Deve.

BACKGROUND OF THE INVENTION

This invention relates to systems of the type that are intended to be employed to reclaim used sand, and, more particularly, to a system for reclaiming used foundry sand by means of thermal reclamation.

Although most people do not commonly view sand as being one of our Nation's diminishing natural resources, to those in the foundry field the shrinking supply of sand of the kind that is usable for foundry purposes is a matter of concern. More specifically, despite the fact that some kinds of sand may be considered to be in relatively plentiful supply, the specific type of sand which is capable of being employed for purposes of making castings through the use of processes associated with foundry operations is, generally speaking, in relatively short supply. That is, the latter type of sand, which for ease of reference will hereinafter be referred to generically by the term "foundry sand" occurs naturally in only selected locations. Thus, as the foundry sand continues to be removed from any given one of these selected locations eventually the supply of foundry sand thereat becomes exhausted. This is precisely what is taking place more and more frequently these days. As a consequence, those employed in the foundry industry who are responsible for acquiring supplies of foundry sand are reaching the point where they can no longer satisfy their requirements for foundry sand simply from local sources. Rather, they are being forced to seek supplies of foundry sand from sources located at ever increasing distances from the site of the foundry at which it is intended to make use of the foundry sand.

Apart from that concern to which reference has been had hereinbefore, which those in the foundry field have with regard to the fact that available sources of supply of foundry sand are becoming fewer and fewer in number, there is yet another matter, which is of concern to those in the foundry industry. This is the matter of the increasing rise in the price of the foundry sand which is available. This increase in the cost of obtaining adequate supplies of foundry sand appears to be occasioned basically by three factors.

The first of these is the fact that sources of supply of available foundry sand are located further and further away from the individual foundry sites. Thus, that segment of the price of foundry sand which is represented by the cost of transporting the foundry sand to the foundry site is becoming a more and more significant factor in the overall cost of obtaining the foundry sand.

The second is a function of the fact that foundry sand is in dwindling supply. Namely, one finds that in the case of most items, as the item becomes less and less available, the price of the item increases in inverse relation to the extent to which the item is available. So it is in the case of foundry sand. Further, as a corollary to this, and something which is particularly true in the case of natural resources, the first of the known natural resources to be removed commonly is that which is the easiest to remove. Thereafter, only after that which is easiest to remove is removed is removal had of that which is more difficult to remove. Concomitantly, the price of the natural resource, e.g., foundry sand, increases in proportion to the cost of removing the natural resource, which in turn normally is a function of the degree of diffculty encountered in effecting the removal of the natural resource.

Yet a third concern of equal, if not in some instances greater, concern faced by those in the foundry field is that presented by the fact that it is becoming increasingly more common to find that chemically-bonded sand is no longer being accepted for disposal at local disposal sites. That is, from an ecological standpoint, environmental protection agencies on the local level are prohibiting the disposal of such chemically-bonded sand at disposal sites which fall within their respective jurisdictions. Thus, those in the foundry field are in need of finding a way of accomplishing the disposal of such chemically-bonded sand in a safe and legal fashion.

As evidenced by a reference to the prior art, there have been attempts made previously in an effort to address one or more of the above-noted concerns. In this regard, the focus of one of these prior art attempts has been on an effort to effect the reclamation of foundry sand. One rationale behind this effort has been that if it were to prove possible to effect a recycling of the foundry sand, this would go far towards forestalling the exhaustion of existing sources of supply of foundry sand. Furthermore, to the extent that recycling of the foundry sand takes place at or in relatively close proximity to the individual foundry sites whereat the use was originally made of the foundry sand, the effect thereof would be to negate substantially, if not totally, the need to incur the expenses associated with the transportation of foundry sand from the sources of supply thereof to the foundry sites. In addition, the ability to reclaim used foundry sand obviates the problem associated with the need to find a suitable disposal site for the used foundry sand.

Insofar as the reclamation of used foundry sand is concerned, there are at least two major requirements, which from a practical standpoint, must be satisfied thereby. Namely, the used foundry sand after being subjected to the reclamation process must be in substantially the same condition as it originally was. That is, the reclamation process must be capable of restoring the used foundry sand to, in essence, its original condition. Secondly, the reclamation of used foundry sand must be capable of being accomplished economically. More specifically, the cost of reclamation must be such that reclamation from a financial standpoint is sufficiently attractive to render it desirable to undertake the investment in terms of time, labor and money required thereby as compared to continuing to purchase new, i.e., not previously used, foundry sand.

With respect to this matter of the reclamation of used foundry sand, a variety of different types of apparatus have been proposed for use. These apparatuses may, for ease of reference, be classified into categories according to the type of treatment to which the used foundry sand is subjected for purposes of effecting the reclamation thereof. Thus, one category into which such apparatus may be placed is that of thermal units. In accord therewith, heat is employed for purposes of accomplishing the removal of organic coatings from the sand particles. By way of exemplification in this regard, there has previously been issued on Aug. 22, 1972 to the applicant of the present invention, U.S. Pat. No. 3,685,165. The latter patent is directed in particular to an apparatus for thermally reclaiming resin coated sand.

A second category of such apparatuses is that of mechanical units. Here, reliance is had, generally speaking, on some form of abrasive action in order to effect the removal of, for example, organic coatings from the particles of sand. This abrasive action may be realized through the action of some sort of mechanical member, or through the use of a so-called "air scrubber". The latter refers to a type of device wherein the sand particles are accelerated to relatively high velocities by means of compressed air such that a rubbing action is caused to occur between individual particles of sand. In other instances, the sand particles after being accelerated are made to impinge against a suitably selected surface such that as a result of this impingement the coating fractures and separates from the individual sand particle. For purposes of illustration of a mechanical unit which has been proposed in the prior art for use in connection with the reclamation of foundry sand, reference may be had to U.S. Pat. No. 4,283,015, that issued on Aug. 11, 1981. This patent depicts an apparatus which is intended to be employed for purposes of removing no-bake coatings from foundry sand.

At this point, it is deemed important that notice be taken of the fact that one should not gain the impression that in order for one to provide a system for effecting the reclamation of used foundry sand, one need only be concerned with the matter of removing organic coatings from sand particles. For, depending on the condition of the foundry sand that it is desired to reclaim, which in turn is a function of the manner in which the foundry sand has been used, a number of other considerations may be of equal, if not greater, importance. For example, significant amounts of used foundry sand are produced during foundry operations wherein the used foundry sand is replete with organic matter, metal, dust and fines.

Attempts have been made, though, to provide systems of a mechanical type which would be commercially acceptable for use to effect the removal of organic matter, metal, dust and fines from used foundry sand. However, the mechanical systems which have been made use of commercially to date have not, particularly in terms of their operation, proven to be entirely satisfactory from a performance standpoint. For example, an undesirable feature of such commercially available prior art forms of mechanical foundry sand relcamation systems is that they frequently suffer from an inability to effect the removal, to the extent desired, of the organic matter from the foundry sand that is being reclaimed. The result, thus, is that future foundry operations are less cost effective, when used foundry sand that has been inadequately reclaimed is employed therein, because additional amounts of new sand must be mixed therewith.

Focusing attention once more on the matter of the thermal reclamation of used foundry sand, and in particular that kind of foundry sand which has organic matter, metal, dust and fines present therein, there are a number of factors to which it is desirable that consideration be given if a thermal foundry sand reclamation system is to be provided that will prove to be viable from a commercial standpoint. More specifically, such a thermal foundry sand reclamation system must be capable of accomplishing the removal of the organic matter from the used foundry sand while at the same time leaving the metal that is also present in the used foundry sand in such a form as to enable it subsequently to be readily removed. Thus, one of the factors that must be taken into account in this regard is that of being able to provide sufficient heat to the used foundry sand so that the organic matter present therein is burned away. However, the operating characteristics of the thermal system must be such that the used foundry sand is not heated excessively, i.e., to such a high temperature that the heat produced is sufficient to effect a change in the state of the metal which is present in the used foundry sand. To this end, such a thermal system for reclaiming used foundry sand must possess the capability of enabling the oganic matter to be burned away, while at the same time that this is being accomplished ensuring that the metal, be it of a ferrous or nonferrous nature, which the used foundry sand contains, is not adversely affected, i.e., rendered more difficult to remove, as a consequence of being exposed to the heat that is employed to burn away the organic matter. In this regard, note is taken here of the fact that some nonferrous metals, e.g., aluminum and zinc, have a significantly different melting temperature than do ferrous metals, and consequently must be treated differently from a temperature standpoint.

Another factor which must be borne in mind when one attempts to provide such a thermal system for reclaiming used foundry sand which contains organic matter, metal, dust and fines is that of the nature of the treatment which should be accorded to the fumes that are generated as the organic matter is being burned away. There are two aspects to this. The first is that of ensuring that such fumes do not pose a danger to the personnel who are attending to the operation of the thermal foundry sand reclamation system. The second is that of ensuring that any fumes which may be exhausted to the atmosphere do not constitute a source of pollutants. That is, that the fumes which are exhausted to the atmosphere as a consequence of the operation of such a thermal system for reclaiming used foundry sand do not violate the regulations applicable thereto as established by the cognizant local, state and federal authorities.

The third factor to which it is essential that consideration be given in providing such a thermal foundry sand reclamation system is the matter of the cost thereof. Namely, both in terms of originally providing the system and in terms of operating the system thereafter, the expenditures required thereby must be such as to render it desirable to undertake the requisite investment as compared to continuing the expenditure of the funds necessary to acquire new foundry sand rather than reclaimed foundry sand.

Related to this matter of cost, which is addressed in the preceding paragraph, is the matter of the production output of reclaimed foundry sand that can be realized through the use of such a thermal foundry sand reclamation system. Reference is had here to the fact that for such a thermal foundry sand reclamation system to be commercially viable, it is necessary that the system embody the capability of providing reclaimed foundry sand in the desired quantities, i.e., in amounts sufficient to meet the need therefor as it exists at any given site at which foundry operations capable of making use thereof take place.

In summary, the salient point which the preceding discussion serves to make is the fact that there clearly has been shown to exist in the prior art a need for a system which is operative to effect the reclamation of used foundry sand. And in particular, the preceding discussion evidences the need in the prior art for a system that is operative to reclaim used foundry sand which contains metal of either a ferrous or nonferrous nature, organic matter, dust and fines. Moreover, from the previous discussion herein, it can be seen that such a reclamation system in order to be deemed acceptable from a commercial standpoint desirably should embody the following features. First, such a system for reclaiming used foundry sand preferably encompasses a lump-crusher, shake-out apparatus operative for purposes of preparing the used foundry sand for subsequent reclamation. Secondly, the subject reclamation system for used foundry sand of necessity includes reclaimer means operative to effect the removal from the used foundry sand of the organic matter that is contained therein. Thirdly, the subject used foundry sand reclamation system preferably includes, if the removal of the organic matter is had by thermal means, primary cooling means for effecting the subsequent cooling of the used foundry sand that is being reclaimed. Fourthly, such a used foundry sand reclamation system desirably encompasses separator means for separating the metal, be the latter of a ferrous or a nonferrous nature, from the used foundry sand. Fifthly, a further desirable feature of such a system for reclaiming used foundry sand is the inclusion therein of classifying, dust removal and scrubber means whereby the foundry sand is classified and the dust and fines are removed. Sixthly, such a reclamation system for used foundry sand desirably incorporates therewithin secondary cooling means for effecting the further cooling of the used foundry sand, which has now had the organic matter, the metal, the dust and the fines removed therefrom, to substantially ambient temperature. Penultimately, to the extent that the subject system for reclaiming used foundry sand is predicated upon the employment of thermal means, the operation thereof should not be disadvantageously characterized insofar as concerns removal of the fumes generated during the course of the burning away of the organic matter which the used foundry sand contains. The final feature which such a reclamation system for used foundry sand must be shown to possess if it is to be viewed to be acceptable from a commercial standpoint is that of being cost effective insofar as concerns the cost of providing the system as well as the cost of operating the system when a comparison thereof is had to the cost of procuring and utilizing new foundry sand as opposed to making use of foundry sand that has been reclaimed through the operation of the aforesaid system.

It is, therefore, an object of the present invention to provide a system for reclaiming used foundry sand and in particular used foundry sand of the kind which is replete with organic matter, metal of either a ferrous or nonferrous nature, dust and fines.

It is another object of the present invention to provide such a system for reclaiming used foundry sand which embodies therein reclaimer means operative for effecting the removal of the organic matter that the used foundry sand contains.

It is still another object of the present invention to provide such a system for reclaiming used foundry sand which embodies primary cooling means for effecting the cooling of the used foundry sand that is being reclaimed subsequent to the removal therefrom by thermal means of the organic matter contained therein.

A further object of the present invention is to provide such a system for reclaiming used foundry sand which embodies separator means for effecting the separation from the used foundry sand that is being reclaimed of the metal, be it of a ferrous or nonferrous nature, that is contained therein.

A still further object of the present invention is to provide such a system for reclaiming used foundry sand which embodies classifying, dust removal and scrubber means for classifying the foundry sand and for removing the dust and fines.

Yet a further object of the present invention is to provide such a system for reclaiming used foundry sand which embodies a secondary cooling means for effecting the further cooling of the used foundry sand, which has now had the organic matter, the metal, the dust and the fines removed therefrom, to substantially ambient temperature.

Yet another object for the present invention is to provide such a system for reclaiming used foundry sand which preferably embodies a lump-crusher, shake-out apparatus that is operative to prepare the used foundry sand for reclamation.

Yet still another object of the present invention is to provide such a system for reclaiming used foundry sand which in a safe and efficient manner effects the removal of the fumes that are generated during the course of the burning away of the organic matter contained in the used foundry sand, and which also is cost effective to provide and to operate when compared to the cost of procuring and using new foundry sand.

SUMMARY OF THE INVENTION

In accordance with the present invention, there is provided a new and improved system for reclaiming by thermal means used foundry sand of the kind that contains organic matter, metal, dust and fines. The subject thermal foundry sand reclamation system includes thermal reclaimer means, post reclaimer means, primary cooling means, separator means, classifying and dust removal means, scrubber means, secondary cooling means and preferably also lump-crusher, shake-out means. The latter lump-crusher, shake-out means is operative to prepare used foundry sand for reclamation by crushing any lumps that may be present in the used foundry sand as well as sifting out of the used foundry sand any material which exceeds a predetermined length. The thermal reclaimer means is operative to accomplish the burning away of the organic matter which the used foundry sand contains. The post reclaimer means is operative for purposes of effecting additional reclaiming of the used foundry sand. The primary cooling means is operative to effect the cooling of the used foundry sand after the latter leaves the thermal reclaimer means. The separator means is operative to effect the removal from the used foundry sand of the metal that is contained therein. Classifying and dust removal means is provided for classifying the foundry sand and for removing the dust and fines. Lastly, the secondary cooling means is operative to effect a further cooling to substantially ambient temperature of the foundry sand that has had the organic matter, the metal, the dust and the fines removed therefrom. The various components that are mentioned above are all arranged in series relation so as to function cooperatively one with another.

DESCRIPTION OF A PREFERRED EMBODIMENT

Figure 1:
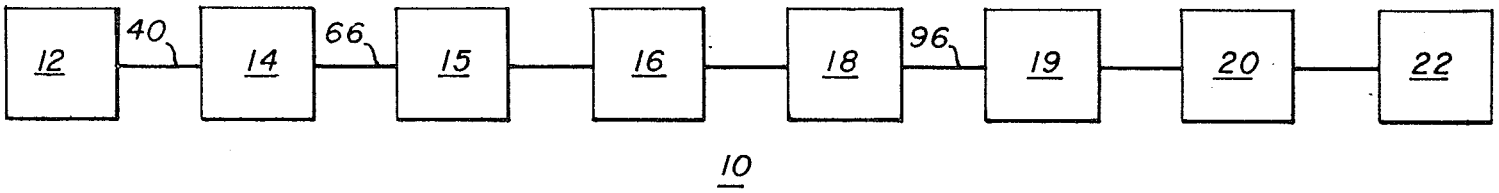
FIG. 1 is a block diagram of a thermal sand reclamation system constructed in accordance with the present invention.

Referring now to the drawing, and more particularly to FIG. 1 thereof, there is depicted therein in block diagram form a thermal sand reclamation system, generally designated by reference numeral 10, constructed in accordance with the present invention. The thermal sand reclamation system 10 is intended to be utilized for purposes of effecting the reclamation of used foundry sand, and in particular used foundry sand of the kind which has therein organic matter, metal of either a ferrous or nonferrous nature, dust and fines. As best understood with reference to FIG. 1, the thermal sand reclamation system 10 includes a multiplicity of components that are suitably arranged so as to be cooperatively associated in series relation one with another. More specifically, in accord with the preferred embodiment of the invention and as shown in FIG. 1, the thermal sand reclamation system 10 comprises the following: a lump-crusher and shake-out means, generally designated by reference numeral 12; thermal reclaimer means, generally designated by reference numeral 14; post reclaimer means, generally designated by reference numeral 15; primary cooling means, generally designated by reference numeral 16; separator means, generally designated by reference numeral 18; classifying means, generally designated by reference numeral 19; scrubber means, generally designated by reference numeral 20; and secondary cooling means, generally designated by reference numeral 22. Continuing with a description of the thermal sand reclamation system 10 and in particular the lump-crusher and shake-out means 12, reference will be had for this purpose to FIG. 2 of the drawing. The function of this lump-crusher and shake-out means 12 is to prepare the used foundry sand for subsequent reclamation by removing therefrom any lumps which may be present therein that are greater than a specific predetermined size and by removing therefrom any material which may be present therein that has dimensions that exceed certain preestablished limits. As such, although the preferred embodiment of the thermal sand reclamation system 10 of the present invention encompasses a lump-crusher and shake-out means 12, the latter means 12 is not absolutely essential to the operation of the thermal sand reclamation system 10. Namely, the lump-crusher and shake-out means 12 is to be viewed as being in the nature of optional equipment whereby it is possible to omit the lump-crusher and shake-out means 12 from the thermal sand reclamation system 10 in those instances wherein the condition of the used foundry sand, which it is desired to reclaim, is such as to render it unnecessary to subject the used foundry sand to the above-described form of preparatory treatment, i.e., where the sand that is to be reclaimed is sufficiently free of undesirably sized lumps and/or material.

Figure 2:
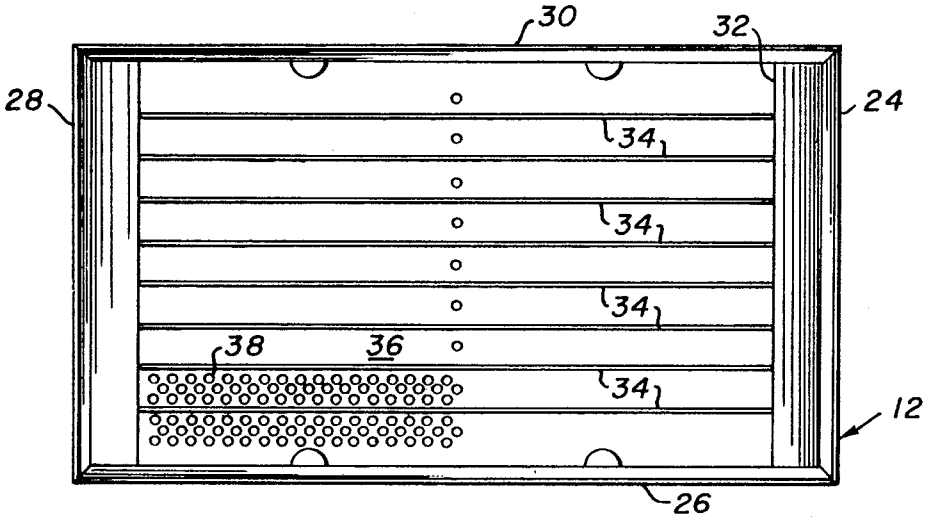
FIG. 2 is a top plan view, partially in section, of a lump-crusher, shake-out apparatus that is suitable for use in the thermal sand reclamation system of FIG. 1 constructed in accordance with the present invention.

A brief description of the nature of the construction and the mode of operation of the lump-crusher and shake-out means 12 of FIG. 2 follows. This brief description is deemed to be sufficient for purposes of obtaining an understanding of the inventive subject matter embodied by the thermal sand reclamation system 10 to which the present patent application is directed. However, since the lump-crusher and shake-out means 12 forms the subject matter of the invention being claimed in copending U.S. patent application, Ser. No. 369,068, entitled "A Lump-Crusher And Shake-Out Apparatus For A Thermal Sand Reclamation System", which has been filed in the name of the same inventor as the present application, and which is assigned to the same assignee as the present application, reference may be had to this copending patent application for a more complete description and illustration of the lump-crusher and shake-out means 12.

In accord with the preferred embodiment thereof, the lump-crusher and shake-out means 12 as shown in FIG. 2 is substantially box-like in configuration. To this end, the lump-crusher and shake-out means 12 includes a multiplicity of side wall members 24, 26, 28 and 30; a bottom wall member (not shown); and an open top 32. Any suitable conventional form of joining means for joining together metallic members can be employed for purposes of accomplishing the joinder of the side wall members 24, 26, 28 and 30 one with another as well as to the bottom wall member (not shown).

Continuing, the used foundry sand that is to be treated in the lump-crusher and shake-out means 12 enters the latter through the open top 32 thereof. In this regard, the used foundry sand may be fed to the open top 32 of the lump-crusher and shake-out means 12 in any suitable conventional manner. As can be seen with reference to FIG. 2, a plurality of elongated members 34 extend between the side wall members 24 and 28. More specifically, the elongated members 34 are suitably mounted in supported relation relative to the side wall members 24 and 28 so as to extend within a common plane in substantially parallel relation one to another. As such, the elongated members 34 are positioned in the path of flow of the used foundry sand as the latter enters the open top 32 of the lump-crusher and shake-out means 12. The elongated members 34 as illustrated in FIG. 2 are suitably positioned so as to be equally spaced one from another. In a manner yet to be described, the elongated members 34 are operative to effect a breaking up of those clumps of sand that the used foundry sand may contain when it enters the lump-crusher and shake-out means 12 through the open top 32 thereof.

After passing between the elongated members 34, the used foundry sand encounters a surface 36 in which there are formed a multiplicity of suitably sized openings 38. Each of the latter openings 38 is of a predetermined dimension, the latter dimension being suitably selected such that the used foundry sand which it is desired to reclaim is capable of passing therethrough. On the other hand, however, any materials that are of a size which exceeds the dimensions of the individual openings 38 are prevented from passing therethrough. That is, any material which is of a diameter that exceeds the diameter of the individual openings 38 will not pass through the latter.

It is important that note be made here of the fact that in flowing through the openings 38, the used foundry sand is moving in a vertical direction. Thereafter, in accord with the preferred form of construction of the lump-crusher and shake-out means 12, the used foundry sand is made to undergo a change in direction (not shown) insofar as the path of flow thereof is concerned. More specifically, the used foundry sand which has been flowing in a vertical path for purposes of passing through the openings 38 is made to flow in a horizontal direction in order to exit from the lump-crusher and shake-out means 12 by means of a suitably constructed discharge chute (not shown). Although not depicted in the drawing, the discharge chute through which the used foundry sand leaves the lump-crusher and shake-out means 12 may be suitably located in one of the side wall members 24, 26, 28 and 30, or in the bottom wall member (not shown) without departing from the essence of the present invention.

The change in direction to which the used foundry sand is subjected after passing through the openings 38 serves to perform yet another function. That is, in addition to being necessary in order to accomplish the conveyance of the used foundry sand through the discharge chute (not shown) the requirement that the aforereferenced change in direction imposes upon the used foundry sand to make a ninety degree turn is employed as a means of preventing elongated members that have a diameter smaller than the diameter of the openings 38 from being carried along with the used foundry sand through the openings 38 to and through the discharge chute (not shown). Namely, if the used foundry sand after passing through the openings 38 also moved in a vertical direction through the discharge chute (not shown), elongated members having a lesser diameter than the diameter of the openings 38 could remain entrained in the used foundry sand and flow therewith through the discharge chute (not shown). However, because of the existence of the aforementioned ninety degree turn through which the used foundry sand must pass in order to flow through the discharge chute (not shown), elongated members being of a length greater than a predetermined dimension are incapable of traversing the aforesaid ninety degree turn. More specifically, elongated members of such a length cannot pass through the discharge chute (not shown) because they do not have the flexibility required in order to undergo the bending that is necessary if they are to move in a vertical direction through the openings 38 and thereafter be subjected to a change in direction through undergoing a ninety degree turn so as to be capable of moving in a horizontal direction in order to pass through the discharge chute (not shown) through which the used foundry sand leaves the lump-crusher and shake-out means 12.

It is to be understood that the lump-crusher and shake-out means 12 is suitably provided with vibratory means (not shown) for purposes of imparting a vibratory action to the used foundry sand that enters the former through the open top 32 thereof. For purposes of a more detailed description and illustration of the aforesaid vibratory means (not shown) reference may be had to copending Patent application, Ser. No. 369,068. The vibratory action to which the used foundry sand is subjected by the aforesaid vibratory means (not shown) is intended to cause any lumps, i.e., clumps, of sand that may be present in the used foundry sand to disintegrate. The latter disintegration takes place as the lumps, i.e., clumps, of sand vibrate, i.e., come into contact, with other sand, materials contained in the sand, the side wall members 24, 26, 28 and 30, the surface 36 and/or the elongated members 34.

For purposes of completing the description herein of the lump-crusher and shake-out means 12 of FIG. 2, a summary will now be had of the mode of operation thereof. To this end, the used foundry sand enters the open top 32 of the lump-crusher and shake-out means 12, whereupon the sand is subjected to a vibratory action as it passes between the elongated members 34. Any lumps that may be present in the sand are caused to disintegrate such that the sand is capable of passing through the openings 38 with which the surface 36 is provided. Those materials, metal or otherwise, that embody a diameter greater than that of the openings 38 do not pass therethrough. In addition, materials, of a metallic nature or not, that are elongated in length beyond a predetermined dimension also are prevented from passing through the discharge chute (not shown) even though the diameter of such elongated materials may be less than the diameter of the openings 38. The manner in which such elongated materials are prevented from passing through the discharge chute (not shown) has been discussed hereinbefore. Finally, periodically, the lump-crusher and shake-out means 12 is shutdown and those materials which have not passed through the openings 38 are suitably removed such as by hand from the surface 36 of the lump-crusher and shake-out means 12.

Figure 3:
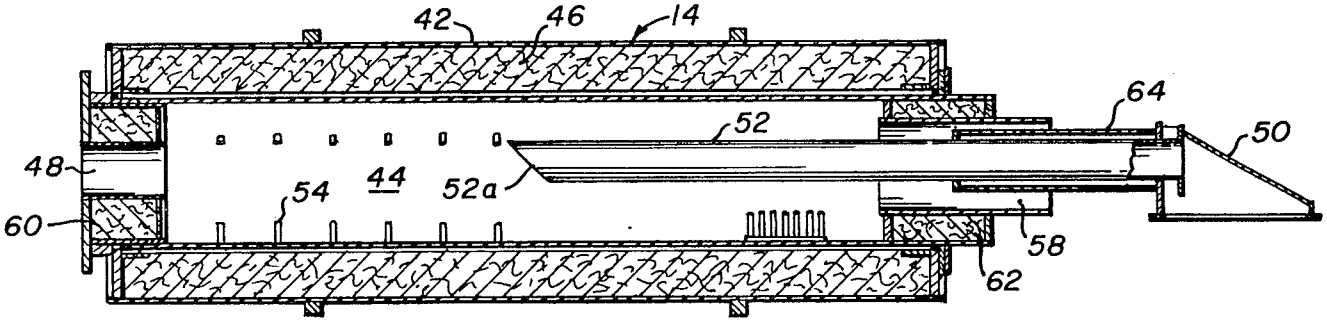
FIG. 3 is a side elevational view, partially in section, of a thermal reclaimer apparatus that is suitable for use in the thermal sand reclamation system of FIG. 1 constructed in accordance with the present invention.

From the lump-crusher and shake-out means 12, the used foundry sand, as depicted schematically at 40 in FIG. 1, is suitably conveyed to the thermal reclaimer means 14. Any means suitable for transporting sand-like material can be employed to effect the conveyance of the used foundry sand between the lump-crusher and shake-out means 12 and the thermal reclaimer means 14. As noted previously hereinbefore, the thermal reclaimer means 14 is operative to effect the removal from the used foundry sand of the organic matter that is contained therein. More specifically, through the use of thermal means, the organic matter which the used foundry sand contains is burned away in the thermal reclaimer means 14. Reference will be had to FIG. 3 of the drawing for a brief description of the nature of the construction and the mode of operation of the thermal reclaimer means 14. The brief description which follows hereinafter of the thermal reclaimer means 14 is deemed to be sufficient for purposes of obtaining an understanding of the inventive subject matter that the thermal sand reclamation system 10 to which the present patent application is directed embodies. However, since the thermal reclaimer means 14 forms the subject matter of the invention being claimed in copending U.S. patent application, Ser. No. 369,334, entitled "A Thermal Reclaimer Apparatus For A Thermal Sand Reclamation System", which has been filed in the name of the same inventor as the present application, and which is assigned to the same assignee as the present application, and which issued on Feb. 7, 1984 as U.S. Pat. No. 4,429,642, reference may be had to this issued U.S. patent for a more complete description and illustration of the thermal reclaimer means 14.

In accord with the preferred embodiment thereof, the thermal reclaimer means 14 as shown in FIG. 3 includes a substantially cylindrically shaped housing 42. Internally thereof and concentric therewith, there is provided a cylindrical chamber 44. It is within this cylindrical chamber 44 that the organic matter which is present in the used foundry sand is burned away in a manner that is yet to be described. Suitable insulation 46 is provided intermediate the cylindrically shaped housing 42 and the cylindrical chamber 44 for purposes of effecting the retention in the cylindrical chamber 44 of the heat that is produced therein for purposes of accomplishing the burning away of the organic matter in the used foundry sand.

After being conveyed to the thermal reclaimer means 14 from the lump-crusher and shake-out means 12, the used foundry sand which contains the organic matter is fed at a controlled rate into the cylindrical chamber 44 through the opening 48. The latter is provided for this purpose at the left end of the thermal reclaimer means 14 as viewed with reference to FIG. 3. More specifically, the used foundry sand containing the organic matter is preferably injected into the cylindrical chamber 44 by hydraulic means (not shown). To this end, the plunger means (not shown) associated with the hydraulic means (not shown) in a manner that is more completely described and illustrated in copending patent application, Ser. No. 369,334, now U.S. Pat. No. 4,429,642, accomplishes the injection of the used foundry sand containing the organic matter, metal, dust and fines into the cylindrical chamber 44 by virtue of the sand being forced thereby through the opening 48 into the cylindrical chamber 44.

Continuing with the description of the thermal reclaimer means 14 of FIG. 3, a burner means 50 is suitably mounted in supported relation at the right end, as viewed with reference to FIG. 3, of the cylindrically shaped housing 42. More specifically, the burner means 50 includes a burner pipe 52 which projects into the cylindrical chamber 44 for a predetermined distance. The fuel which is employed for purposes of accomplishing the burning away of the organic matter in the used foundry sand is fed from a suitable source of supply thereof to and through the burner pipe 52 into the interior of the cylindrical, i.e., combustion, chamber 44.

The thermal reclaimer means 14 embodies rotating means (not shown) for purposes of effecting the rotation of the cylindrically shaped housing 42 relative to the burner means 50 and the inlet means, i.e., opening 48, through which the used foundry sand is made to enter the cylindrical chamber 44. For an illustration and a more detailed description of the aforesaid rotating means (not shown), reference may be had to copending patent application, Ser. No. 369,334, now U.S. Pat. No. 4,429,642. Here, however, it is sufficient to note that the used foundry sand in which the organic matter is present enters the cylindrical chamber 44 through the opening 48 and travels the length of the cylindrical chamber 44, i.e., from left to right as viewed with reference to FIG. 3, as the cylindrically shaped housing 42 is caused to rotate by the rotating means (not shown).

During the course of this travel, the organic matter in the used foundry sand is burned away. To this end, the temperature to which the used foundry sand is heated is preselected so as to be high enough to accomplish the burning away of the organic matter, yet low enough so that the metal which the used foundry sand also contains is not adversely affected by the heat. In accord with the preferred embodiment of the invention, if the metal which the used foundry sand contains is of a ferrous nature, the temperature to which the used foundry sand is heated is approximately 1300° F. On the other hand, if the metal which the used foundry sand contains is a nonferrous metal such as aluminum which has a melting temperature of less than 1500° F., the temperature to which the used foundry sand is heated is approximately 900° F. Moreover, in the case of nonferrous metal such as aluminum or zinc, in order to accomplish the complete removal of the organic matter which the used foundry sand contains, it is necessary to subject the used foundry sand to a second pass through either the same cylindrical chamber 44 or through a second cylindrical chamber 44. Furthermore, in the case of such nonferrous metals having a melting temperature of less than 1500° F., the metal is sifted, i.e., separated, from the used foundry sand before the latter is passed a second time through a cylindrical chamber 44. In this regard, since the nonferrous metal is sifted from the used foundry sand between the first and second passes through a cylindrical chamber 44, there is no restriction against heating the used foundry sand during its second pass through a cylindrical chamber 44 to a temperature approximating 1300° F. for purposes of completing the removal, i.e., burning away, of the organic matter that the used foundry sand contains.

It is also to be noted here that the speed of rotation of the cylindrically shaped housing 42 is also preselected. That is, the speed of rotation is selected to be such that the sand in moving through the cylindrical chamber 44 is provided with a sufficiently long residence time therein in order so that the desired burning away of the organic matter in the used foundry sand can take place.

To assist in the removal by thermal means of the organic matter which the used foundry sand contains, preferably there are provided a plurality of pin-like members 54 suitably supported on the inner wall of the cylindrically shaped housing 42 such that each projects into the interior of the cylindrical chamber 44. As seen with reference to FIG. 3 of the drawing, the pin-like members 54 are positioned in spaced relation one to another, and preferably are limited to being located in essentially only the left half of the cylindrical chamber 44 as viewed with reference to FIG. 3. In the right portion of the cylindrical chamber 44, on the other hand, three sets of comb-like members 56, each arranged in a group of three (only one shown in FIG. 3), are preferably provided in equally distant relation around the circumference of the cylindrical chamber 44. Although the cylindrical chamber 44 is described as embodying three sets of comb-like members 56, it is to be understood that the exact number of comb-like members 56 with which a cylindrical chamber such as the chamber 44 is provided is a function of the size of the cylindrical chamber 44. Each individual one of the comb-like members 56 of each group thereof is in turn inclined at the free end thereof and projects into the interior of the cylindrical chamber 44. The inclined ends of the comb-like members 56 function to pick up out of the used foundry sand any lumps that may be present therein and to cause such lumps to free fall, i.e., drop, against the interior side walls of the cylindrical chamber 44 as the latter rotates whereby these lumps are made to break up. The function of the pin-like members 54 and the comb-like members 56, thus, is to cause a continual turning over, i.e., tumbling, of the used foundry sand and the material contained therein as well as to cause a breaking up of lumps in the used foundry sand as the used foundry sand traverses the length of the cylindrical chamber 44. This is to insure that no portion of the sand remains unexposed, which in turn could lead to an incomplete removal of the organic matter from the used foundry sand.

Upon reaching the right end, as viewed with reference to FIG. 3, of the cylindrical chamber 44, the used foundry sand minus the organic matter, which has been burned away in the cylindrical chamber 44, exits from the latter, and thus also from the thermal reclaimer means 14. More specifically, in accord with the illustrated embodiment of the thermal reclaimer means 14, a suitable opening denoted by the reference numeral 58 in FIG. 3 is provided in surrounding relation to the burner pipe 52. It is through this opening 58 that the used foundry sand from which the organic matter has been removed passes from the cylindrical chamber 44 of the thermal reclaimer means 14.

With further reference to FIG. 3, it can be seen therefrom that suitable insulation 60 is provided in surrounding relation to the opening 48 through which the used foundry sand enters the cylindrical chamber 44. The insulation 60 cooperates with the inner wall of the cylindrically shaped housing 42 to establish a form of seal therebetween, in addition to performing an insulative function, i.e., preventing heat from escaping to the exterior of the cylindrical chamber 44. Similarly, at the other end of the cylindrically shaped housing 42 insulation 62 is provided. The insulation 62, in a manner analogous to that of the insulation 60, is effective to establish a form of seal between the inner wall of the cylindrically shaped housing 42 and the pipe-like member that defines the opening 58 through which the used foundry sand passes from the cylindrical chamber 44.

For purposes of completing the description herein of the thermal reclaimer means 14 of FIG. 3, a summary will now be had of the mode of operation thereof. To this end, the used foundry sand containing the organic matter is fed at a controlled rate by hydraulic means (not shown) through the opening 48 into the cylindrical chamber 44. The hydraulic means (not shown) may be made to operate either automatically or manually. As the used foundry sand traverses the length of the cylindrical chamber 44, the cylindrically shaped housing 42 rotates while simultaneously hot gases exit from the end 52*a* of the burner pipe 52. The used foundry sand is thus heated by these hot gases to a temperature sufficient to effect the burning away of the organic matter contained therein, while the metal that the used foundry sand also contains is not adversely affected by the temperature to which the sand is heated. In this regard, the organic matter is itself combustible and thus serves to provide some of the fuel required for the burning thereof. The residence time of the used foundry sand is a function in part of the speed of rotation of the cylindrically shaped housing 42 as well as the rate at which the used foundry sand is fed into the cylindrical chamber 44. To this end, a residence time of approximately two hours has been found to be appropriate. Further, the amount of used foundry sand that can be treated for removal of organic matter in a given period of time is a function of the volume of the cylindrical chamber 44.

Continuing, as the used foundry sand moves from one end to the other of the cylindrical chamber 44, it is constantly being turned over through the action of the pin-like members 54 and the comb-like members 56 so that all of the sand is exposed and lumps in the used foundry sand are broken up whereby to insure the complete removal of the organic matter that is contained therein. The used foundry sand from which the organic matter has been removed exits from the cylindrical chamber 44 through the opening 58. Finally, note is made of the fact that some of the air to support combustion comes into the cylindrical chamber 44 with the used foundry sand through the opening 48. Additional combustion air is supplied into the cylindrical, i.e., combustion, chamber 44 through a pipe-like member 64 that surrounds the burner pipe 52 for a portion of the length of the latter. In addition to its use for combustion purposes, the air that flows into the cylindrical chamber 44 from the pipe-like member 64 performs two other functions. First, it serves to blow the gases, which are generated as the organic matter that the used foundry sand contains is being burned up, back into the cylindrical chamber 44 where these gases are exposed further to the combustion process. Secondly, it inhibits the escape of the used foundry sand from the cylindrical chamber 44 other than through the opening 58.

Figure 4:
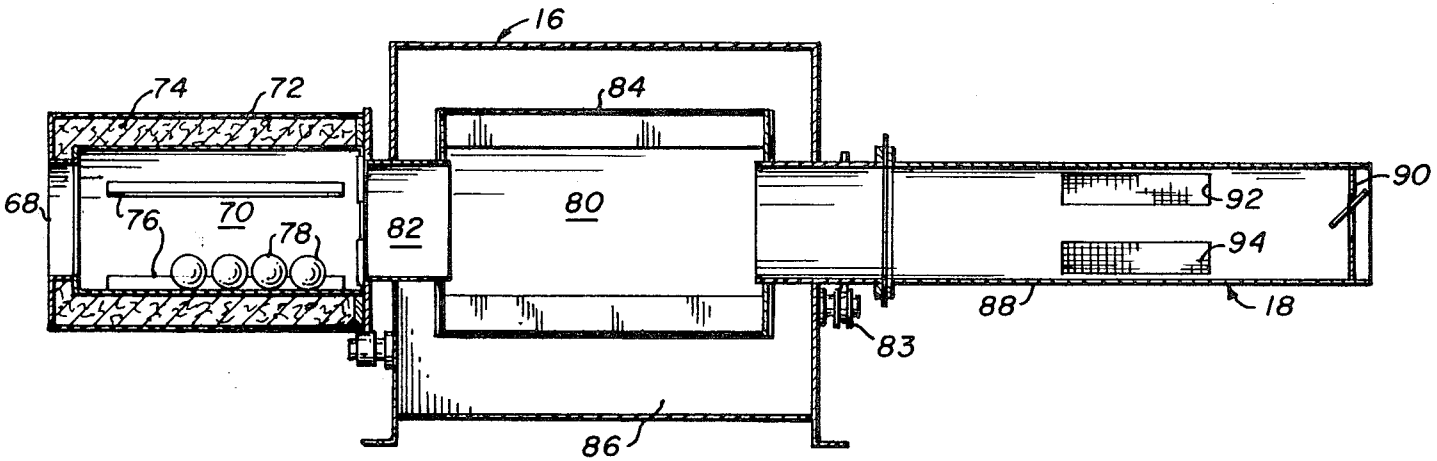
FIG. 4 is a side elevational view, partially in section, of a post reclaimer, cooling and separator assembly, consisting of post reclaimer means and primary cooling means cooperatively associated with separator means, that is suitable for use in the thermal sand reclamation system of FIG. 1 constructed in accordance with the present invention.

After leaving the thermal reclaimer means 14, the used foundry sand from which the organic matter has now been removed is suitably conveyed, as has been schematically depicted at 66 in FIG. 1, to the post reclaimer, cooling and separator assembly. Any means suitable for transporting sand-like material can be employed to effect the conveyance of the used foundry sand between the thermal reclaimer means 14 and the post reclaimer, cooling and separator assembly. As noted previously hereinbefore, the post reclaimer, cooling and separator assembly includes a post reclaimer means, generally designated by the reference numeral in FIGS. 1 and 4, a primary cooling means, generally designated by the reference numeral 16 in FIGS. 1 and 4, and a separator means, denoted generally in FIGS. 1 and 4 by the reference numeral 18. The function of the post reclaimer means 15 is to cause the process of removal of the organic matter from the used foundry sand to continue as the latter cools as a result of radiation from a temperature of 1300° F. to a temperature of approximately 1000° F. The function of the primary cooling means 16 is to effect a cooling of the used foundry sand that has been heated to a temperature of approximately 1300° F. in the thermal reclaimer means 14 for purposes of removing therefrom, i.e., burning away, the organic matter, which was contained in the used foundry sand. The separator means 18, on the other hand, is operative for purposes of removing from the used foundry sand the metal, be it of a ferrous or nonferrous nature, which remained in the used foundry sand after the latter was passed through the thermal reclaimer means 14. Reference will be had to FIG. 4 of the drawing for a brief description of the nature of the construction and the mode of operation of the aforementioned post reclaimer, cooling and separator assembly. The brief description which follows hereinafter of the post reclaimer, cooling and separator assembly is deemed to be sufficient for purposes of obtaining an understanding of the inventive subject matter that the thermal sand reclamation system 10 to which the present patent application is directed embodies. However, since the post reclaimer, cooling and separator assembly forms the subject matter of the invention being claimed in copending U.S. patent application, Ser. No. 369,476, entitled "A Post Reclaimer, Cooling And Separator Assembly For A Thermal Sand Reclamation System", which has been filed in the name of the same inventor as the present application, and which is assigned to the same assignee as the present application, reference may be had to this copending patent application for a more complete description and illustration of the post reclaimer, cooling and separator assembly.

In accord with the preferred embodiment thereof, the post reclaimer means 15, as shown in FIG. 4, is provided at the left end thereof, as viewed with reference to the aforesaid Figure, with a suitably located opening 68 through which the used foundry sand enters the post reclaimer means 15 after being conveyed thereto from the thermal reclaimer means 14. After passing through the opening 68, the used foundry sand flows into a cylindrical chamber 70. Surrounding the cylindrical chamber 70 is a housing 72 which contains insulation 74, the latter being intended to be operative to prevent the escape to the atmosphere of the heat which the used foundry sand embodies. In the cylindrical chamber 70, the reclamation process by which the organic matter is burned away continues as the temperature of the used foundry sand decreases from 1300° F. to approximately 1000° F. This decrease in temperature occurs as a result of radiation. In summary, the post reclaimer means 15 is operative to provide the used foundry sand with additional residence time whereby the removal of the organic matter from the used foundry sand is completed in a most economical manner. That is, to provide the used foundry sand with this additional residence time would significantly add to the cost of providing the thermal sand reclamation system 10, if this residence time were to be provided in the thermal reclaimer apparatus 14.

As best understood with reference to FIG. 4, the cylindrical chamber 70 preferably is provided with a plurality of elongated members 76 suitably supported on the inner surface of the housing 72 so as to extend parallel to the major axis of the cylindrical chamber 70. In addition, a multiplicity of ceramic balls 78 are also to be found within the cylindrical chamber 70. The function of the elongated members 76 and the ceramic balls 78 is to effect a further crushing of any lumps that the used foundry sand may still contain. In effect, as will be further described hereinafter, the used foundry sand is made to undergo a form of tumbling action within the cylindrical chamber 70.

After traversing the length of the cylindrical chamber 70, the used foundry sand enters the cylindrical chamber 80 with which the primary cooling means 16 is provided. However, before it can enter the cylindrical chamber 80, the used foundry sand must first pass through a member 82 which embodies the general configuration of a wheel, the latter consisting of a rim from which a plurality of spokes radiate to a central, i.e., common, point. The dimensions of the openings between the spokes of the member 82 are selected to be such that the ceramic balls 78 which are present in the cylindrical chamber 70 are incapable of passing through the member 82 into the interior of the cylindrical chamber 80 although the used foundry sand is itself free to flow through the member 82, i.e., to pass from the cylindrical chamber 70 into the cylindrical chamber 80.

Although not fully illustrated in FIG. 4, the post reclaimer, cooling and separator assembly that is depicted therein embodies rotational means 83 operative for effecting the rotation of the cylindrical chamber 70, the cylindrical chamber 80, and the yet to be described separator means 18. It is deemed sufficient at this point though to simply note with reference to FIG. 4 that the rotation to which the cylindrical chamber 70 is subjected by the aforesaid rotational means 83 is operative to cause the used foundry sand that has been fed thereinto to rotate along with the cylindrical chamber 70. The effect in turn of this rotation on the used foundry sand is to cause the latter to continually turn over, i.e., tumble, such that any lumps which the used foundry sand may still contain are crushed through the action of the ceramic balls 78.

With reference once again to the cylindrical chamber 80, the latter is defined by a cylindrically shaped housing 84 which has an external configuration that consists of adjoining inverted V-shaped projections (not shown). The latter projections (not shown) which are illustrated and described more fully in copending patent application, Ser. No. 369,476 have the peaks, i.e., points, thereof projecting outwardly away from the center of the cylindrical chamber 80 for a purpose yet to be described. The housing 84 is suitably supported so as to be rotatable by the aforedescribed rotational means 83. To this end, the housing 84 rotates about an axis which is concentric with the major axis of each of the cylindrical chambers 80 and 70, as well as the major axis of the separator means 18. Moreover, the housing 80 is made to rotate through a suitably dimensioned tank 86. The latter tank 86 is filled to a predetermined level with a suitable cooling fluid, which in accordance with the preferred embodiment of the invention consists of water.

Thus, as the housing 84 rotates through the water that is contained in the tank 86, the used foundry sand, which is still at an elevated temperature in access of 1000° F. as it passes into the cylindrical chamber 80 from the cylindrical chamber 70, undergoes cooling. To improve the heat transfer characteristics of the housing 84, the latter has formed around the circumference thereof the previously described inverted V-shaped projections (not shown). The effect of the latter projections (not shown) is to give the circumference of the housing 84 a corrugated appearance. In essence, the aforesaid inverted V-shaped projections (not shown) provide additional surface area for purposes of heat transfer. That is, the used foundry sand which is present in the cylindrical chamber 80 flows into the interior of each of the inverted V-shaped projections (not shown)

as the housing 84 is caused to rotate. Accordingly, on one side, i.e., the inside, of each of the inverted V-shaped projections (not shown) as the housing 84 rotates there is hot sand, while the other side, i.e., the outside, of each of the inverted V-shaped projections (not shown) rotates through the water which is in the tank 86. In this manner, the cooling of the hot used foundry sand is effected as it passes through the interior of the housing 84, i.e., the cylindrical chamber 80, essentially entirely by the water in the tank 86. Consequently, by the time the used foundry sand exits from the cylindrical chamber 80, the used foundry sand which had been heated to a temperature approximating 1300° F. in the cylindrical chamber 44 of the thermal reclaimer means 14 has now been cooled to a temperature approximating 300° F.

Referring again to FIG. 4 of the drawing, after being cooled significantly in the course of its travel through the cylindrical chamber 80, the used foundry sand which is free of organic matter but which still contains metal, dust and fines leaves the cylindrical chamber 80 and enters the separator means 18. The latter separator means 18 comprises basically an elongated tubular member 88 having one end thereof cooperatively associated in a suitable manner with the exit end of the cylindrical chamber 80, and having the other end thereof terminating in a suitably sized opening 90 for a purpose yet to be described. The tubular member 88 is suitably supported so as to be rotatable by the aforesaid rotational means (not shown) in unison with the housing 84 of the primary cooling means 16.

At a point intermediate the ends thereof, the tubular member 88 has a plurality of openings 92 formed therein. The openings 92 are arranged in spaced but aligned relation around the circumference of the tubular member 88. Each of the openings 92 has suitably mounted either therein or in juxtaposed relation thereto a suitably sized screen-like member 94.

In accord with the mode of operation of the separator means 18, as the tubular member 88 rotates the used foundry sand travels along the length thereof from left to right as viewed with reference to FIG. 4. Furthermore, as the used foundry sand reaches the openings 92, the sand particles that have a lesser diameter than the size of the openings in the screen-like members 94 pass through the latter, and are suitably collected for subsequent conveyance to the scrubber means 20 of the classifier scrubber and cooling assembly. The metal, on the other hand, as well as any sand particles that are too large to pass through the screen-like members 94 continue there travel through the tubular member 88, and ultimately exit therefrom through the opening 90 with which the tubular member 88 is provided for this purpose, whereupon the material that exits from the opening 90 is collected in any suitable manner.

For purposes of completing the description herein of the post reclaimer, cooling and separator assembly of FIG. 4, a summary will now be had of the mode of operation thereof. To this end, the used foundry sand which has been heated to a temperature on the order of 1300° F. in the thermal reclaimer means 14 is fed from the latter to the post reclaimer means 15. More specifically, the hot used foundry sand from which organic matter has been removed in the thermal reclaimer means 14 but which still contains some organic matter and metal enters the cylindrical chamber 70 through the opening 68 provided therein for this purpose. As the post reclaimer means 15, and in particular the cylindrical chamber 70 thereof is made to rotate by means of the rotational means 83, the hot used foundry sand travels the length of the cylindrical chamber 70 whereby the used foundry sand is exposed to additional residence time. Moreover, while cylindrical chamber 70 rotates, the hot used foundry sand therein is subjected to a form of tumbling action. As a consequence thereof additional burning away of the organic matter takes place. In addition, in conjunction with the action of the ceramic balls 78 any lumps of sand that may still remain in the used foundry sand are crushed.

When the used foundry sand, which is still hot, reaches the member 82 it passes through the openings therein defined by the spokes thereof, and enters the cylindrical chamber 80. It is within the latter chamber 80 that the hot used foundry sand is cooled from a temperature approximately of 1000° F. to a temperature on the order of 300° F. More specifically, the latter cooling occurs as a consequence of the heat transfer that takes place from the hot used foundry sand through the inverted V-shaped projections (not shown) to the water contained in the tank 86. This is accomplished as the housing 84 rotates through the water in the tank 86. A further effect of this rotation of the housing 84 is that the used foundry sand present within the cylindrical chamber 80 also rotates thereby insuring that there is a continual exposure of different surfaces of the sand.

After being cooled in the cylindrical chamber 80 during the course of its travel therethrough, the used foundry sand leaves the chamber 80 and enters the tubular member 88 of the separator means 18. The tubular member 88 is also caused to rotate by the rotational means 83 with which the post reclaimer, cooling and separator assembly of FIG. 4 is provided. As a consequence of this rotation of the tubular member 88, the used foundry sand travels along the length thereof. Upon reaching the openings 92 those sand particles that are of sufficiently small size pass through the screen-like members 94 that are emplaced over the openings 92. These sand particles are suitably collected and are then conveyed in any suitable manner to the classifying, scrubber and cooling assembly of the thermal sand reclamation system 10. While the metal and those sand particles that are too large to pass through the screen-like members 94 continue to travel within the tubular member 88 until they reach the opening 90 from whence they are discharged.

Figure 5:
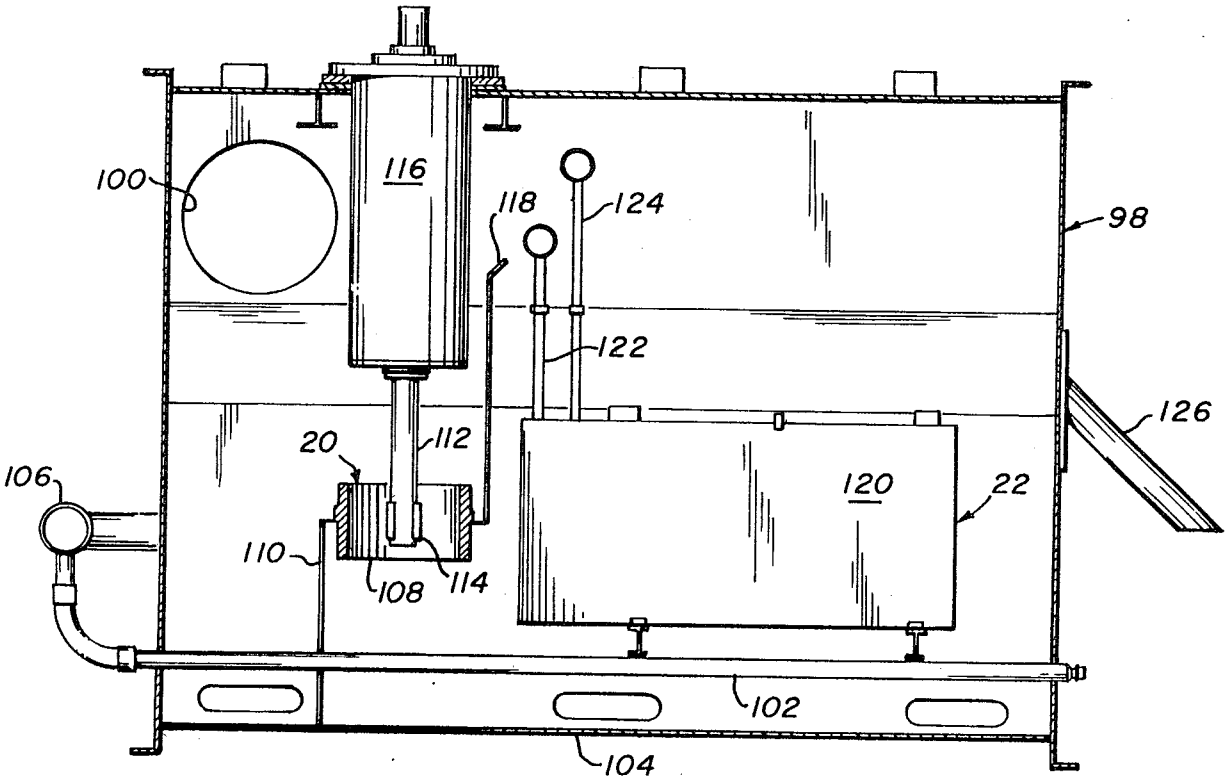
FIG. 5 is a side elevational view, partially in section, of a classifying, scrubber and cooling assembly, consisting of classifying, dust and fine removal, and scrubber means cooperatively associated with secondary cooling means, that is suitable for use in the thermal sand reclamation system of FIG. 1 constructed in accordance with the present invention.

From the post reclaimer, cooling and separator assembly illustrated in FIG. 4, the used foundry sand from which both the organic matter and the metal have now been removed is suitably conveyed, as schematically depicted at 96 in FIG. 1, to the classifying, scrubber and cooling assembly shown in FIG. 5. Any means suitable for transporting sand-like material can be employed to effect the conveyance of the used foundry sand between the post reclaimer, cooling and separator assembly of FIG. 4, and the classifying, scrubber and cooling assembly of FIG. 5. As noted previously hereinbefore, the classifying, scrubber and cooling assembly includes a classifying and dust removal means, generally designated by the reference numeral 19 in FIGS. 1 and 5, a scrubber means, generally designated by the reference numeral 20 in FIGS. 1 and 5, and a secondary cooling means, denoted generally in FIGS. 1 and 5 by the reference numeral 22. The function of the classifying and dust removal means 19 is to effect a classification of the used foundry sand and to effect the removal of dust and fines. The function of the scrubber means 20 is to effect a scrubbing of the dust from the sand particles. The secondary cooling means 22, on the other hand, is operative to effect a further cooling to substantially ambient temperature of the foundry sand that has had the organic matter, the metal, dust and fines removed therefrom.

Reference will now be had to FIG. 5 of the drawing for a brief description of the nature of the construction and the mode of operation of the aforementioned classifying, scrubber and cooling assembly. The brief description which follows hereinafter of the classifying, scrubber and cooling assembly is deemed to be sufficient for purposes of obtaining an understanding of the inventive subject matter that the thermal sand reclamation system 10 to which the present patent application is directed embodies. However, since the classifying, scrubber and cooling assembly forms the subject matter of the invention being claimed in copending U.S. patent application, Ser. No. 369,335, entitled "A Classifying, Scrubber And Cooling Assembly For A Thermal Sand Reclamation System", which has been filed in the name of the same inventor as the present application, and which is assigned to the same assignee as the present application, reference may be had to this copending patent application for a more complete description and illustration of the classifying, scrubber and cooling assembly.

In accord with the preferred embodiment thereof, the classifying, scrubber and cooling assembly, as shown in FIG. 5, is suitably encased in a housing-like enclosure 98. The latter enclosure 98 is suitably dimensioned and configured so as to provide sufficient space therewithin for housing the classifying and dust removal means 19, the scrubber means 20 and the secondary cooling means 22 of the classifying, scrubber and cooling assembly.

Turning first to a consideration of the scrubber means 20, the used foundry sand which passes through the screen-like members 94, after being suitably collected is conveyed to the enclosure 98 and enters the latter through any suitably dimensioned opening provided for this purpose which is located in one of the walls of the enclosure 98, such as the opening identified by the reference numeral 100 in FIG. 5, which is upstream of the scrubber means 20. Upon entering the enclosure 98, the used foundry sand that is now free of both organic matter and metal is subjected to a fluidizing action. To this end, a plurality of pipes 102 are suitably supported adjacent the bottom surface 104 of the enclosure 98. These pipes 102 are suitably arranged so as to be spaced one from another, and so as to extend the length of the enclosure 98 in parallel relation to each other. Moreover, each of the pipes 102 is suitably connected in fluid flow relation to an external supply 106 of fluid, e.g., compressed air. The latter compressed air which enters the pipes 102 from the supply 106 thereof exits therefrom through a series of openings which each of the pipes 102 is provided. The latter openings (not shown) preferably are formed in the under surface of the pipes 102, as viewed with reference to FIG. 5, in order to prevent sand from entering thereinto when the classifying, scrubber and cooling assembly is not in operation. The velocity of the compressed air is regulated in any suitable manner such as by a regulation of the external supply 106 thereof.

Continuing with the description of the scrubber means 20, the used foundry sand, as noted above, after it enters the enclosure 98 through the opening 100 comes under the influence of the compressed air which is being blown out of the openings (not shown) with which the pipes 102 are provided. More specifically, the effect of the compressed air being blown through that portion of the interior of the enclosure 98, which is occupied by the scrubber means 20, is to create a fluidizing effect therewithin. The nature of the latter fluidizing action is such that the used foundry sand is caused to be transported, as a consequence of this blowing of the compressed air, from the opening, i.e., inlet, 100 to the scrubber sleeve 108 of the scrubber means 20. A suitable baffle-like member such as the member 110 is positioned within the interior of the enclosure 98. This baffle-like member 110 serves to assist in guiding the used foundry sand in its travel from the inlet 100 to that area of the interior of the enclosure 98 in which the scrubber sleeve 108 is fixedly supported through the use of any suitable conventional form of support means (not shown).

With further reference to FIG. 5, a shaft 112 to which a plurality of paddles 114 are suitably affixed extends into the interior of the scrubber sleeve 108. The shaft 112 is suitably supported so as to lie along, i.e., so as to be coincident with, the axis which passes through the center of the scrubber sleeve 108. The shaft 112 and thus also the paddles 114, which are affixed thereto, are rotatable. To this end, the scrubber means 20 includes motor means 116 suitably mounted within the interior of the enclosure 98. The motor means 116 is operative to effect the rotation of the shaft 112 and thereby also the paddles 114 within the scrubber sleeve 108.

As the used foundry sand passes through the scrubber sleeve 108, the sand particles rub against each other and as a consequence of such rubbing any dust that may be on the individual sand particles is dislodged therefrom. More specifically, the particles of the used foundry sand as they pass through the interior of the scrubber sleeve 108 are thrown outwardly towards the inner surface of the scrubber sleeve 108 by centrifugal force, the latter being derived from the rotation of the paddles 114 which are fixed to the shaft 112. In accord with the preferred embodiment of the scrubber means 20, the inner surface of the scrubber sleeve 108 is provided with indentations (not shown) extending throughout the entire circumference thereof. The latter indentations (not shown) provide the inner surface of the scrubber sleeve 108 with a scallop-like configuration. The function of the aforesaid indentations (not shown) is to provide an interrupted surface that is effective to ensure that a layer of sand particles does not become established along the inner wall of the scrubber sleeve 108. The establishment of such a layer of sand is to be avoided for it could have an adverse effect on the efficiency of operation of the scrubber means 20.

After passing through the scrubber sleeve 108, the sand particles, still under the influence of the compressed air that is being blown out of the pipes 102, continue their travel through the interior of the enclosure 98 to the secondary cooling means 22. The sand particles as they leave the scrubber sleeve 108 are guided in their path of movement by that portion of the baffle-like member 110 denoted by the reference numeral 118 in FIG. 5. The dust and fines, on the other hand, are caused to exit from the enclosure 98 by the compressed air that exits from pipes 102. To this end, the size of the particles of dust and fines which are removed by the compressed air is a function of the velocity of the latter. A suitable opening (not shown) is provided for this purpose, i.e., the removal of the dust and fines, in the enclosure 98 preferably adjacent to the location of the motor identified at 116 in FIG. 5. After passing through the latter opening (not shown) the dust and fines are collected in a dust collector (not shown) of conventional construction.

In accord with the illustration of FIG. 5, the secondary cooling means 22 takes the form of a plurality of plate-like members 120. The latter members 120 are suitably mounted within the interior of the enclosure 98 so as to bear a parallel relationship to each other. Each of the plate-like members 120 embodies a cooling tube (not shown) arranged in a serpentine pattern therewithin. The ends of each of these cooling tubes (not shown) are suitably connected in fluid flow relation to the pipe headers 122 and 124. That is, one of the pipe headers 122, 124 functions as an inlet and the other as an outlet for cooling fluid that flows to, through and from each of the cooling tubes (not shown) that the plate-like members 120 embody. To this end, the pipe headers 122, 124 in turn are suitably connected to an external supply of a suitable cooling fluid, which in the preferred embodiment consists of water. Thus, as the sand particles are moving in a manner analogous to a liquid through the enclosure 98 and thus through the spaces between adjoining ones of the plate-like members 120, the sand particles are cooled as a consequence of the cooling action produced by the flow of the cooling fluid through the cooling tubes (not shown). More specifically, the sand particles as they complete their traverse of the plate-like members 120 are cooled to a temperature approaching ambient temperature, e.g., 100° F. To summarize, the sand that exits from the enclosure 98 through the discharge chute 126 with which the former is suitably provided is substantially in the same condition as original foundry sand. That is, the sand which is collected from the discharge chute 126 has been fully reclaimed such that it no longer contains organic matter, metal, dust and fines, and thus is in a condition suitable for reuse in foundry operations without adversely affecting the latter in any regard. As a matter of fact, it has been found that insofar as the casting process itself is concerned, properly reclaimed foundry sand is better than original foundry sand. The reason for this is that in the course of the usage thereof, a change in the crystal state of the silica sand occurs which renders the silica sand more stable. In turn, the utilization of silica sand which is stable reduces mold-cracking.

For purposes of completing the description herein of the classifying, scrubber and cooling assembly of FIG. 5, a summary will now be had of the mode of operation thereof. To this end, the used foundry sand enters the enclosure 98 through the opening 100 and comes under the influence of the compressed air being blown out of the pipes 102. The effect of the blowing of this compressed air is to cause a fluidizing action to be established. The sand particles are thus caused to be conveyed by virtue of this fluidizing action to the scrubber sleeve 108. In the course of passing through the scrubber sleeve 108, the sand particles are thrown outwardly, i.e., towards the inner wall of the scrubber sleeve 108 by virture of the rotation imparted to the paddles 114 by the shaft 112. The effect of this movement that the sand particles undergo in passing through the scrubber sleeve 108 is that the sand particles are rubbed against each other such that any dust thereon is dislodged therefrom. The dust and fines are removed by the compressed air through a suitable opening (not shown) provided for this purpose in the enclosure 98.

From the scrubber means 20, the sand particles are conveyed still under the influence of the compressed air exiting from the openings (not shown) in the pipes 102 to the secondary cooling means 22. More specifically, upon reaching the secondary cooling means 22 the sand particles travel the length of the plate-like members 120 and are cooled in the course of this passage to a temperature approaching ambient temperature. After being thus cooled, the sand is discharged through the chute 126 as reclaimed used foundry sand free of organic matter, metal, dust and fines, and which can now be reused for making castings through the use of processes associated with foundry operations.

Thus, in accordance with the present invention there has been provided a new and improved system for reclaiming used foundry sand and in particular used foundry sand of the kind which is replete with organic matter and metal of either a ferrous or nonferrous nature, dust and fines. Moreover, the subject system for reclaiming used foundry sand of the present invention embodies therein reclaimer means operative for effecting the removal of the organic matter that the used foundry sand contains. In addition, in accord with the present invention a system for reclaiming used foundry sand is provided which embodies primary cooling means for effecting the cooling of the used foundry sand that is being reclaimed subsequent to the removal therefrom by thermal means of the organic matter contained therein. Further, the subject system for reclaiming used foundry sand of the present invention embodies separator means for effecting the separation from the used foundry sand that is being reclaimed of the metal, be it of a ferrous or nonferrous nature, that is contained therein. Additionally, in accordance with the present invention a system for reclaiming used foundry sand is provided which embodies classifying, dust removal and scrubber means for classifying the foundry sand and for removing the dust and fines. Also, the subject system for reclaiming used foundry sand embodies a secondary cooling means for effecting the further cooling of the used foundry sand, which has now had the organic matter, the metal, dust and fines moved therefrom, to substantially ambient temperature. Penultimately, in accordance with the present invention a system for reclaiming used foundry sand is provided which preferably embodies a lump-crusher, shake-out apparatus that is operative to prepare the used foundry sand for reclamation. Lastly, the subject system for reclaiming used foundry sand effects in a safe and efficient manner the removal of the fumes that are generated during the course of the burning away of the organic matter contained in the used foundry sand, and also is cost effective to provide and to operate when compared to the cost of procuring and using new foundry sand.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

I claim:

1. A system for reclaiming used foundry sand that contains organic matter, dust, fines and metal, the latter being of either a ferrous or nonferrous nature comprising:

a. thermal reclaimer means operative for thermally removing organic matter from the used foundry sand, said thermal reclaimer means including a rotatable housing having a chamber formed internally thereof and in concentric relation thereto so as to be rotatable therewith, said chamber having an inlet opening formed therein at one end thereof through which the used foundry sand to be reclaimed enters said chamber, said chamber having burner means mounted at the other end thereof so as to extend into said chamber, said burner means being operative to heat the used foundry sand in said chamber to a predetermined temperature as said chamber rotates to effect the thermal removal of organic matter from the used foundry sand, said chamber having an outlet opening formed at the other end thereof in surrounding relation to said burner means through which the used foundry sand from which organic matter has been removed exits from said chamber of said thermal reclaimer means;

b. primary cooling means cooperatively associated with said thermal reclaimer means for receiving the used foundry sand therefrom and for effecting the cooling of the used foundry sand subsequent to the removal therefrom of the organic matter, said primary cooling means including a tank containing a cooling medium therein and a chamber mounted for rotation within said tank, said chamber of said primary cooling means having an inlet opening formed therein at one end thereof for receiving the used foundry sand that is to be cooled and having an outlet opening formed therein at the other end thereof through which the used foundry sand exits from said primary cooling means after being cooled in said chamber as said chamber rotates in said tank containing a cooling medium therein;

c. separator means cooperatively associated with said primary cooling means for receiving the used foundry sand therefrom and for effecting the separation of the metal from the used foundry sand, said separator means including a rotatable tubular member having an inlet opening formed at one end thereof through which the used foundry sand enters said separator means, said tubular member having a plurality of openings formed intermediate the ends thereof, each of said plurality of openings having a screen-like member positioned in mounted relation thereto, said tubular member having a discharge opening formed at the other end thereof through which material too large to pass through said screen-like members as said tubular member rotates is discharged; and d. scrubber means cooperatively associated with said separator means for receiving the used foundry sand therefrom and for effecting a scrubbing of the used foundry sand, said scrubber means including a scrubber sleeve having a shaft mounted for rotation therewithin, said scrubber sleeve having an inlet opening through which used foundry sand enters said scrubber sleeve and an outlet opening through which used foundry sand exits from said scrubber sleeve, said shaft having a plurality of paddles affixed thereto for rotation therewith, said plurality of paddles through the rotation thereof causing the sand particles of the used foundry sand passing through said scrubber sleeve to rub against one another and thereby be subjected to a scrubbing action.

2. The system for reclaiming used foundry sand as set forth in claim 1 further comprising secondary cooling means cooperatively associated with the scrubber means for receiving the used foundry sand therefrom and for effecting a further cooling of the used foundry sand to a temperature approaching ambient temperature, said secondary cooling means including a plurality of plate-like members supported in spaced relation one to another, each of said plurality of plate-like members embodying a cooling tube through which a cooling medium is caused to flow so as to be operative to cool the used foundry sand to substantially ambient temperature as the used foundry sand is made to pass between said plurality of plate-like members.

3. The system for reclaiming used foundry sand as set forth in claim 2 further comprising a lump-crusher and shake-out means cooperatively associated with said thermal reclaimer means for supplying used foundry sand thereto and for effecting a crushing of lumps of sand that may be present in the used foundry sand and a shaking out of the used foundry sand of elongated members having a length that exceeds a predetermined dimension and of material exceeding a predetermined diameter, said lump-crusher and shake-out means including a vibratory box-like structure having an open top, said box-like structure having a plurality of elongated members supported therewithin below and in spaced relation to said open top thereof, said plurality of elongated members effecting the breaking up of clumps of sand contained in the used foundry sand as the used foundry sand entering said box-like structure through the open top thereof is being vibrated within said lump-crusher and shake-out means.

4. The system for reclaiming used foundry sand as set forth in claim 3 further comprising post reclaimer means cooperatively associated with said thermal reclaimer means for receiving the used foundry sand therefrom and for effecting a further reclaiming of the used foundry sand, said post reclaimer means including a chamber having an inlet opening formed at one end thereof through which the used foundry sand enters said chamber of said post reclaimer means and an outlet opening formed at the other end thereof through which the used foundry sand exits from said chamber of said post reclaimer means after being subjected to additional residence time at an elevated temperature within said chamber of said post reclaimer means during which the organic matter remaining in the used foundry sand is burned away.

* * * * *